US005399932A

United States Patent [19]

Anzai et al.

[11] Patent Number: 5,399,932

[45] Date of Patent: Mar. 21, 1995

[54] THREE GUN COLOR CRT WHICH HAS THREE GRIDS WITH THE HOLES IN THE THIRD GRID SHIFTED RELATIVE TO THE HOLES IN FIRST AND SECOND GRIDS

[75] Inventors: Hiroki Anzai, Fukushima; Yukinobu Iguchi, Kanagawa, both of Japan

[73] Assignee: Sony Corporation, Tokyo, Japan

[21] Appl. No.: 53,211

[22] Filed: Apr. 28, 1993

[30] Foreign Application Priority Data

Apr. 30, 1992 [JP] Japan ..... 4-111136

[51] Int. Cl.[6] ..... H01J 29/51

[52] U.S. Cl. ..... 313/414; 313/415

[58] Field of Search ..... 313/409, 412, 414–415

[56] References Cited

U.S. PATENT DOCUMENTS 4,870,321 9/1989 Kamohara ..... 313/414
4,885,505 12/1989 Koshigoe et al. ..... 313/414
4,922,166 5/1990 Ichida et al. ..... 313/414
5,039,906 8/1991 Park ..... 313/414
5,077,497 12/1991 Kamohara et al. ..... 313/414

FOREIGN PATENT DOCUMENTS 29 34 498 3/1981 Germany .

*Primary Examiner*—Stephen Brinich
*Attorney, Agent, or Firm*—Hill, Steadman & Simpson

[57] ABSTRACT

An electron beam for a color CRT is equipped with three cathodes such that three electron beams may be emitted therefrom. Three grids are provided with beam passing holes for each of the three electron beams and are positioned in the path of the electron beams. The beam passing openings of the third grid are shifted from alignment with the beam passing openings of the first and second grid by a degree sufficient to focus the three beams appropriately relative to a central focal axis of the electron gun.

17 Claims, 2 Drawing Sheets

THREE GUN COLOR CRT WHICH HAS THREE GRIDS WITH THE HOLES IN THE THIRD GRID SHIFTED RELATIVE TO THE HOLES IN FIRST AND SECOND GRIDS

BACKGROUND OF THE INVENTION

1. Field of The Invention

The present invention relates generally to an electron gun for a color CRT (cathode ray tube ). Specifically, the present invention relates to a technique for correcting a spot shift amount for electron beams output by an electron gun of a color CRT.

2. Description of The Prior Art

In a color CRT it is preferable that a shift amount for spot movement of electron beams on a light receiving surface comes to zero. Spot shifting of electron beams is caused by geomagnetism, dimensional displacement of the electron gun in a thermal process, or the like. Conventionally, a magnetic shield plate is arranged on the CRT to minimize geomagnetic effects. However, spot shift due to other causes could not be prevented. New higher definition standards require that spot shift be held as low as possible to provide image stability and higher image definition.

SUMMARY OF THE INVENTION

It is therefore a principal object of the present invention to overcome the drawbacks of the prior art.

It is a further object of the present invention to provide an electron gun for a color CRT capable of easily correcting a shift amount of spot movement of electron beams.

In order to accomplish the aforementioned and other objects, an electron gun for a color cathode ray tube is provided, comprising: three cathodes arranged in line with each other; a first grid having a first voltage applied thereto; a second grid having a second voltage applied thereto, the second voltage being higher than the first voltage; a third grid having a third voltage applied thereto, the third voltage being equal to an anode voltage of the electron gun; the electron gun operable such that three electron beams emitted from the three cathodes are commonly focused at a main focusing lens after passing through respective apertures provided in the first, second and third grids and converged so as to be displayed on a phosphor screen panel; characterized in that: the apertures of the third grid are shifted in relation to the apertures of the second grid by a predetermined degree in parallel with an in line direction of the electron beams such that a focused position of the electron beams is located on a center axis of the electron gun.

According to another aspect of the invention, an electron gun for a color CRT is provided, comprising: an electron gun for a color CRT, comprising: an electron gun having three cathodes capable of each emitting an electron beam, respectively; a low potential first grid; a middle potential second grid; and a high potential third grid, the first, second and third grids arranged such that three electron beams emitted from the three cathodes are focused after the beams pass through beam passing holes of the first, second and third grids, the beam passing holes of the third grid being shifted from alignment with the beam passing holes of the second grid by a degree sufficient to effect a focused position of the electron beams are appropriately aligned relative to a central axis.

DESCRIPTION OF THE PREFERRED EMBODIMENT

Figure 1:
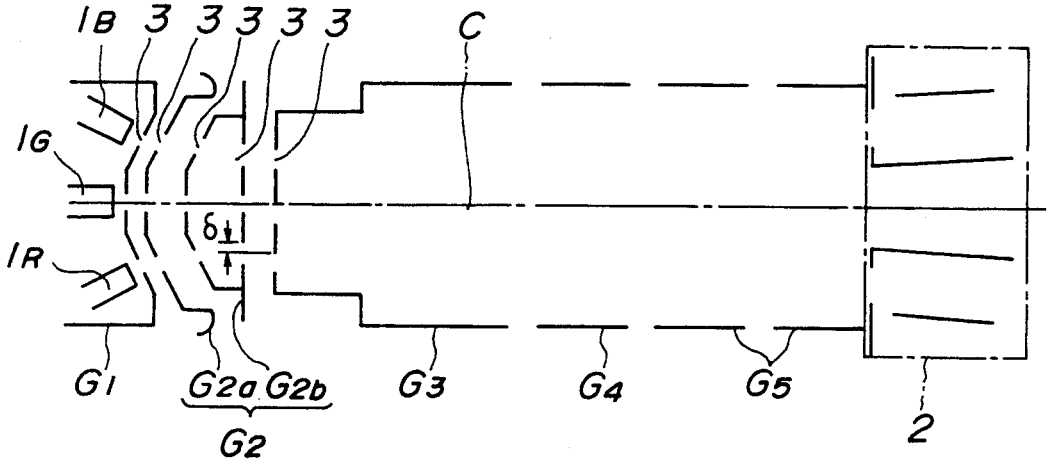
FIG. 1 is a schematic block diagram of a color CRT according to the preferred embodiment of the invention.
Figure 2:
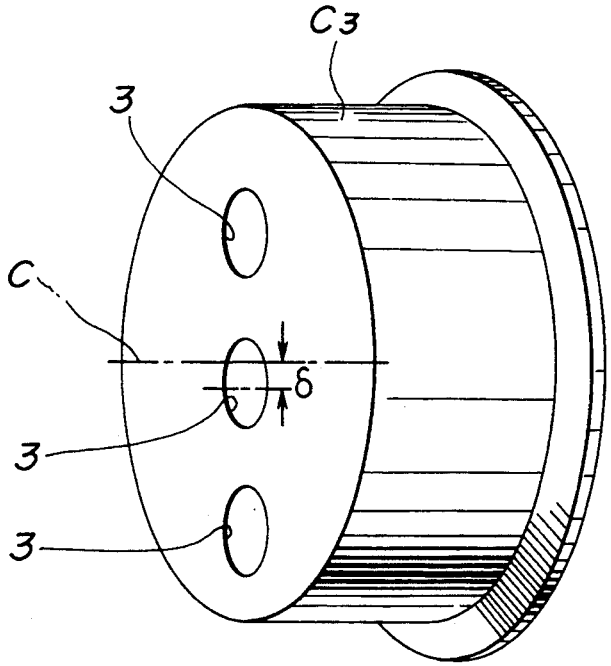
FIG. 2 is a perspective view of a third grid used in the CRT of the preferred embodiment.

Referring now to the drawings, particularly to FIG. 1, a schematic block diagram of an electron gun for a color CRT according to the preferred embodiment of the invention is shown. As may be seen in the drawing, the electron gun comprises three parallel and horizontally arranged cathodes $\mathbf{1}_R$, $\mathbf{1}_G$ and $\mathbf{1}_B$ for emitting three electron beams R, G and B. Five grids $G_1$–$G_5$ are arranged consecutively in the path of the electron beams R, G and B. A convergence deflecting section 2 forming a unipotential lens, is also provided after the fifth grid $G_5$.

The electrical potential of the first grid $G_1$ is set to be lower than a potential of the three cathodes $\mathbf{1}_R$, $\mathbf{1}_G$ and $\mathbf{1}_B$ and the second grid $G_2$ comprises a main grid section $G_2$a and an auxiliary grid section $G_2$b and is set to a substantially middle electrical potential. The third grid $G_3$ and the fifth grid $G_5$ are set to a high potential substantially that of an anode (not shown) of said electron gun. The fourth grid is set to a low to middle potential of 0 to 400 v, for example. The three electron beams R, G, B are focused at the position of the fourth grid $G_4$ by receiving external force in the direction of a central focal axis C.

Three beam passing holes **3*b*, 3*g*, 3*r*, are provided in each of the first grid $G_1$, the main grid section $G_2$a, the auxiliary grid section $G_2$b and the third grid $G_3$ respectively. The beam passing holes 3*g*, of grids $G_1$, $G_2$a and $G_2$b are formed so as to be substantially aligned with the focal axis C, while the beam passing holes 3*b* and 3*r*** of each of the grids $G_1$, $G_2$a and $G_2$b are formed so as to be laterally and symmetrically oriented toward the focal axis C.

However, the holes **3*b*, 3*g* and 3*r* of the third grid $G_3$ are formed at a position on the third grid $G_3$ which is shifted by a value "δ" from a position aligned with the holes 3*b*, 3*g* and 3*r*** of the first and second grids $G_1$ and $G_2$ in parallel with the directions of the electron beams R, G, and B. A process of determining the value of "δ" will be explained in detail hereinbelow.

Figure 3:
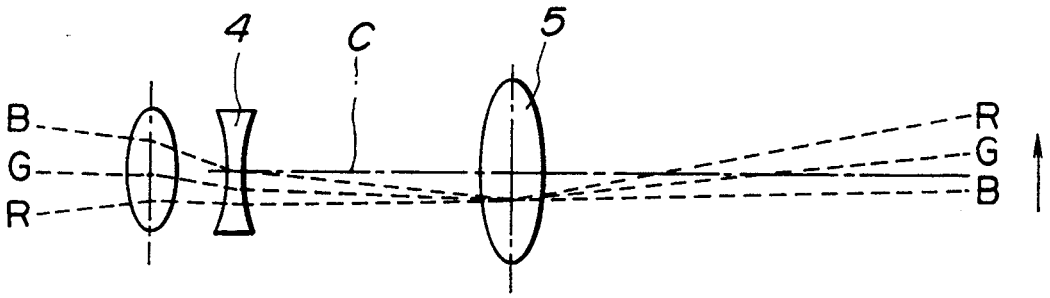
FIG. 3 is a representation of a conventional electron lens function of each grid when a beam passing through the third grid is not shifted.
Figure 4:
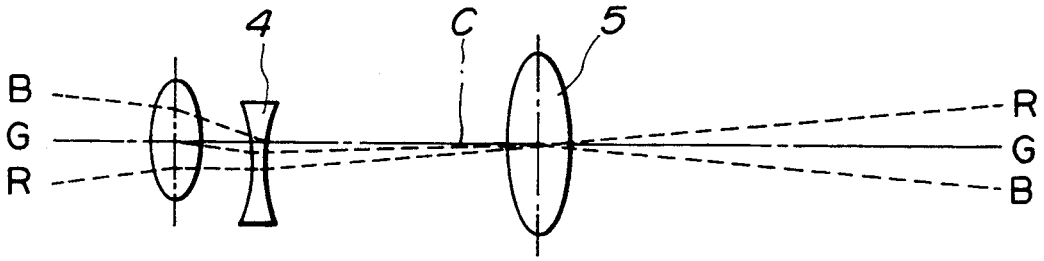
FIG. 4 is a representation of an electron lens function of each grid according to the invention, when a beam passing through the third grid is shifted.

Referring to FIGS. 3 and 4, the functions of the grids are represented as electron lenses for representing the focusing properties of the beam passing holes **3*b*, 3*g*, 3*r* of the grids. According to this, the third grid $G_3$ serves as a concave lens 4, the fourth grid $G_4$ serves as a main lens 5 (convex lens), and the three electron beams are focused at the main lens 5. As seen in FIG. 3, is the positions of the beam passing holes of the third grid $G_3$ are not shifted, a focal convergence is not aligned with the focal axis C and spot shift occurs due to geomagnetism, dimensional displacement of the electron gun in thermal process, etc. Thus, if the beam passing holes 3 of the third grid $G_3$ are shifted in a direction so as to align the beams correctly relative to the focal axis C at the fourth grid $G_4$ the effect is the same as repositioning the concave lens 4. The amount of shift "δ" is thus determined to a point where the electron beams R, G, and B emitted from the three cathodes $1_R$, $1_G$ and $1_B$ are focused at a position where they do not shift from the central axis C of the main lens 5**.

According to this arrangement, the three electron beams R, G, B, from the three cathodes $1_R$, $1_G$, $1_B$, are commonly converged and then pass through a color selection mask (not shown) to form an image on a light receiving surface (not shown) of the cathode ray tube, which light receiving surface may be a phosphor screen, or the like.

Further, as described above the present invention makes it possible to correct shift amounts for spot movement of electron beams R, G, B, not only due to geomagnetic influences but also spot shift due to any other cause, since the beam passing holes 3 of the third grid $G_3$ are shifted from alignment with the beam passing holes 3 of the second grid $G_2$ so that the focusing position of the electron beams is brought onto the central axis C. Moreover, this advantage may be implemented via a relatively simple design modification.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An electron gun for a color cathode ray tube, comprising:

three cathodes arranged in line with each other;

a first grid having a first voltage applied thereto;

a second grid having a second voltage applied thereto, said second voltage being higher than said first voltage;

a third grid having a third voltage applied thereto, said third voltage being equal to an anode voltage of said electron gun;

said electron gun operable such that three electron beams emitted from said three cathodes are commonly focused at a main focusing lens after passing through respective apertures provided in said first, second and third grids and converged so as to be displayed on a phosphor screen panel;

characterized in that:

the apertures of said third grid are shifted in relation to said apertures of said second grid by the predetermined degree in parallel with an in line direction of said electron beams such that a focused position of said electron beams is located on a center axis of said electron gun.

2. An electron gun as set forth in claim 1, wherein said second grid comprises a main grid portion and an auxiliary grid portion, each of said main and auxiliary grid portions having beam passing apertures for each of said electron beams, respectively.

3. An electron gun as set forth in claim 1, wherein said apertures of said first grid are aligned with said apertures of said second grid.

4. An electron gun as set forth in claim 1, wherein said focused position of said electron beams after passing through said apertures of said third grid are focused on a fourth grid set after said third grid along a path of said electron beams.

5. An electron gun as set forth in claim 4, wherein said fourth grid is set to a voltage of 0 to 400 v.

6. An electron gun as set forth in claim 1, wherein an voltage of said first grid set to be lower than a voltage of said three cathodes.

7. An electron gun as set forth in claim 4, further comprising a fifth grid set after said fourth grid along said path of said electron beams.

8. An electron gun as set forth in claim 7, wherein said third grid and said fifth grid are set to a voltage substantially equal to that of an anode of said electron gun.

9. An electron gun for a color CRT, comprising:

an electron gun having three cathodes capable of each emitting an electron beam, respectively;

a low potential first grid;

a middle potential second grid; and a high potential third grid, said first, second and third grids arranged such that three electron beams emitted from said three cathodes are focused after the beams pass through beam passing holes of said first, second and third grids, said beam passing holes of said third grid being shifted from alignment with said beam passing holes of said second grid by a degree sufficient to effect that the focused position of said electron beams are appropriately aligned relative to a central axis of said electron gun.

10. An electron gun as set forth in claim 9, wherein said second grid comprises a main grid portion and an auxiliary grid portion, each of said main and auxiliary grid portions having beam passing holes for each of said electron beams, respectively.

11. An electron gun as set forth in claim 9, wherein said beam passing holes of said first grid are aligned with said beam passing holes of said second grid.

12. An electron gun as set forth in claim 9, wherein said focused position of said electron beams after passing through said beam passing holes of said third grid are focused on a fourth grid set after said third grid along a path of said electron beams.

13. An electron gun as set forth in claim 12, wherein said fourth grid is set to a low to middle potential of 0 to 400 v.

14. An electron gun as set forth in claim 9, wherein an electrical potential of said first grid set to be lower than a potential of said three cathodes.

15. An electron gun as set forth in claim 9, wherein said second grid comprises a main grid section and an auxiliary grid section which are set to a substantially middle electrical potential.

16. An electron gun as set forth in claim 12, further comprising a fifth grid set after said fourth grid along said path of said electron beams.

17. An electron gun as set forth in claim 16, wherein said third grid and said fifth grid are set to a high potential substantially equal to that of an anode of said electron gun.

* * * * *